United States Patent [19]

Bohnenkamp

[11] Patent Number: 4,513,491

[45] Date of Patent: Apr. 30, 1985

[54] METHOD OF ROLLING WIDE STRIP STARTING MATERIAL

[75] Inventor: Heinrich Bohnenkamp, Neuss-Uedesheim, Fed. Rep. of Germany

[73] Assignee: SMS Schloemann-Siemag Aktiengesellschaft, Dusseldorf, Fed. Rep. of Germany

[21] Appl. No.: 507,079

[22] Filed: Jun. 23, 1983

[30] Foreign Application Priority Data

Jul. 7, 1982 [DE] Fed. Rep. of Germany ..... 3225313

[51] Int. Cl.[3] ..... B22D 11/126

[52] U.S. Cl. ..... 29/527.7; 164/76.1; 164/476

[58] Field of Search ..... 29/527.7; 164/98, 99, 164/91, 108, 76, 476

[56] References Cited

U.S. PATENT DOCUMENTS

| | | | |
|---|---|---|---|
| 993,698 | 5/1911 | McConway | 29/527.7 |
| 3,958,987 | 5/1976 | Chia et al. | 29/527.7 |
| 4,407,056 | 10/1983 | Watanabe et al. | 29/527.7 |

*Primary Examiner*—Howard N. Goldberg
*Assistant Examiner*—V. K. Rising
*Attorney, Agent, or Firm*—Holman & Stern

[57] ABSTRACT

In a method of rolling wide strip starting material, an ingot slab is rolled to the desired wide strip width by having its shorter sides edge-rolled. In order to save time, energy, material and investment capital, the ingot slab has a cross-section tapered towards the shorter sides in a wedge-shaped or curved manner at both edges, and is edge-rolled approximately to the wide strip width desired while filling out the rectangular shape.

2 Claims, 4 Drawing Figures

METHOD OF ROLLING WIDE STRIP STARTING MATERIAL

The invention relates to a method of rolling wide strip starting material, in which an ingot slab is rolled to the desired wide strip width by having its shorter sides edge-rolled.

In order to roll wide strip of various widths, starting material graded in accordance with the desired wide strip is generally used in wide strip trains. The starting material may be graded in terms of width either by casting ingot slabs of various widths or by intensive edge-rolling, i.e. reducing the width of ingot slabs of uniform cross-section. Both methods have substantial disadvantages.

If the grading with respect to width is to be carried out inside a continuous casting plant, adjustable ingot moulds are required for this. Setting the size of a continuous casting ingot mould during an interruption in casting represents a loss in production and additional assembly operations. Setting the size of a continuous casting ingot mould during the casting operation requires expensive adjustment and control apparatus. In the process unusable wedge-shaped transition pieces are formed between the sizes, as a result of which production is likewise limited.

In the known edge-rolling of ingot slabs to the desired wide strip widths, bulges are formed on the longer sides. When these bulges are removed by slabbing, the slab is substantially widened again, so that the edge-rolling operation must be repeated several times until the desired width is achieved. During the slabbing of the bulges an increased lengthening of the material to be rolled occurs in the region of the said bulges, so that its ends assume a fish-tail shape. This portion is lost as scrap. The known edge-rolling of the ingot slabs to varying widths further requires an expensive width-reducing rolling mill which can only be used economically for an output of over 4 million tonnes.

SUMMARY OF THE INVENTION

The object of the invention is to avoid the disadvantages of the known methods; more specifically the object is to provide a method of rolling starting material for wide strip from ingot slabs, such that it is possible to edge-roll the ingot slabs for the purpose of adaptation to different wide strip widths with a reduced expenditure of time, energy, material and investment capital.

According to the invention an ingot slab with a cross-section tapered towards the shorter sides in a wedge-shaped or curved manner at both edges is edge-rolled approximately to the wide strip width desired while filling out a rectangular overall shape.

In this way a reduction in width of the ingot slab is made possible without bulges on the longer sides of the slab, so as to avoid widening again during slabbing, and the necessary reduction in width can normally be achieved in one edging pass. This reduction of edging passes and slabbing passes saves time and energy. Since, with the new method, a fish tail is no longer formed at the end of the starting material, the occurrence of scrap is substantially reduced.

Preferably the ingot slabs are produced by continuous casting. Continuous casting of the slabs tapered towards the shorter sides in a wedge-shaped or curved manner at both edges leads, without adjustment of the ingot moulds, to higher productivity with less capital expenditure.

DETAILED DESCRIPTION OF THE INVENTION

Figure 1:
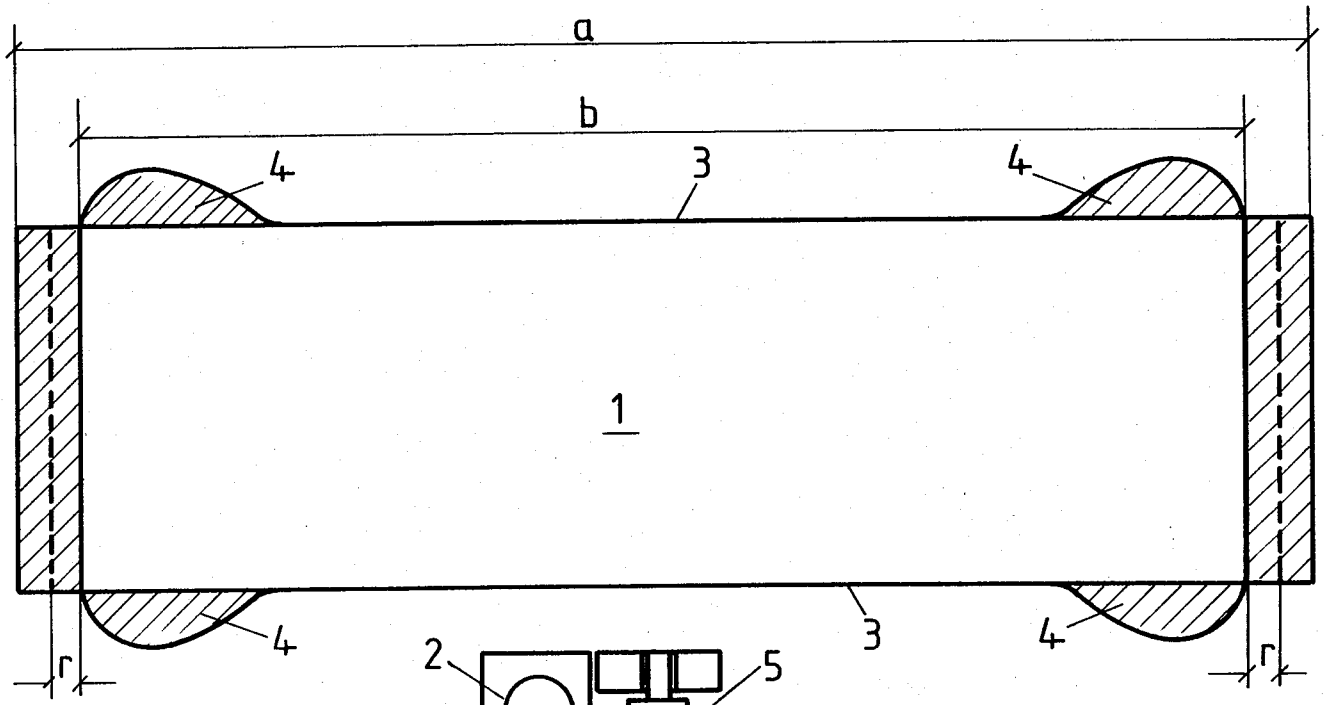
FIG. 1 is the cross-section of a rectangular ingot slab before and after an edging pass according to the prior art.
Figure 2:
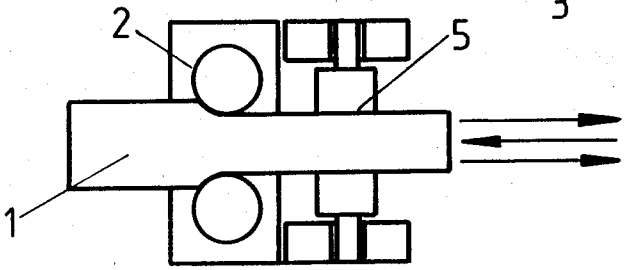
FIG. 2 is a diagrammatic view of a conventional width-reducing train comprising an edge-rolling apparatus and a horizontal-rolling apparatus.

In the known method illustrated by FIG. 1 an ingot slab 1 with a rectangular cross-section is edge-rolled down from width a to width b by means of an edge-rolling apparatus 2 according to FIG. 2. This causes bulges 4 to be formed on the longer slab sides 3. The bulges 4 must be flattened by a slabbing pass in the horizontal-rolling apparatus 5 arranged downstream. This leads to a rewidening by the amount 2r, necessitating futher edge rolling. Three rolling passes are necessary, therefore, to achieve the new width b.

Figure 3:
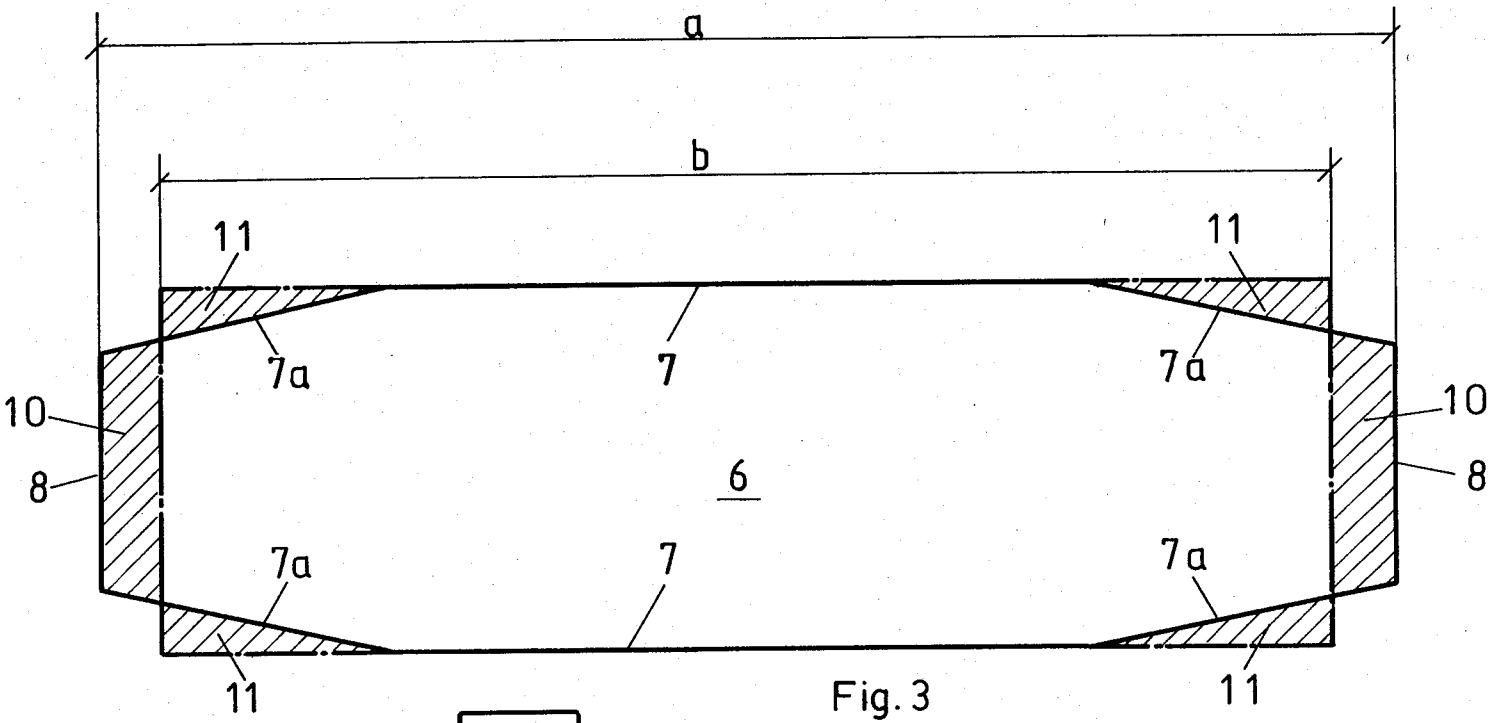
FIG. 3 is the cross-section of an ingot slab before and after rolling by the method according to the invention.

According to the invention a novel ingot slab 6 according to FIG. 3 is used, the longer sides 7 of which are provided with bevelled or chamfered outer side regions **7*a* which extend the cross-section of the slab in a tapering wedge-shaped manner towards the narrow sides 8** of the slab.

Figure 4:
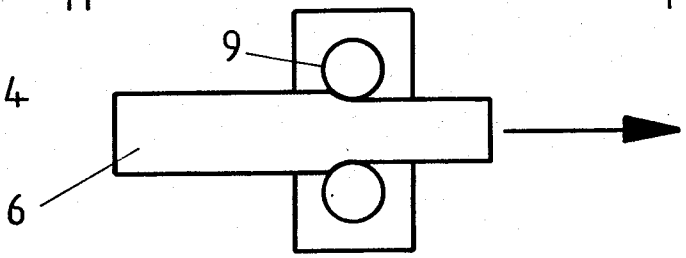
FIG. 4 is a diagrammatic view of an edge-rolling apparatus for performing the method according to the invention.

The narrow sides 8 are then edge rolled by the edge-rolling apparatus 9 (FIG. 4). The edge-rolled material 10 is thereby displaced and fills corner regions 11 adjoining the initial bevelled surface regions **7*a* of the slab, until an overall rectangular shape of the rolled slab is produced. Because of the tapered initial shape of the edge regions, no bulges are formed on the longer sides 7** so that subsequent slabbing, with the drawback that the slab is rewidened, may be dispensed with.

The ingot slab illustrated in FIG. 3 can be reduced to the desired strip width in one edging pass just on the edge-rolling apparatus 9 without slabbing passes on a horizontal-rolling apparatus. A special horizontal-rolling apparatus for removing bulges is thus dispensed with.

The special taper-edged shape of the ingot slabs 6 may preferably be produced by continuous casting. The invention is not, however, restricted only to the ingot slab shape in the form of a truncated wedge illustrated in FIG. 3. Thus for example the invention may also be performed with an ingot slab which is tapered with a curve on both sides.

I claim:

1. A method of rolling wide strip starting material, in which an ingot slab is rolled approximately to the desired wide strip width by having its shorter sides edge-rolled, characterized by the steps of providing an ingot slab with a cross-section tapered towards the shorter sides of the slab at both edges, and edge-rolling the slab thereby reducing the slab width and causing the edge regions of the slab to adopt a rectangular shape by displacement of material from the slab edges to regions adjoining the initially tapered regions of the slab.

2. The method of claim 1 further characterized by forming the ingot slab by continuous casting.

* * * * *